US007072447B2

(12) United States Patent
Graf et al.

(10) Patent No.: US 7,072,447 B2
(45) Date of Patent: Jul. 4, 2006

(54) DEVICE FOR FILTERING AN X-RAY BEAM

(75) Inventors: Harald Graf, Speichersdorf (DE); Gerhard Wurzer, Mantel (DE)

(73) Assignee: Siemens AG (DE)

( * ) Notice: Subject to any disclaimer, the term of this patent is extended or adjusted under 35 U.S.C. 154(b) by 54 days.

(21) Appl. No.: 10/494,473

(22) PCT Filed: Oct. 18, 2002

(86) PCT No.: PCT/DE02/03945

§ 371 (c)(1),
(2), (4) Date: Apr. 28, 2004

(87) PCT Pub. No.: WO03/041090

PCT Pub. Date: May 15, 2003

(65) Prior Publication Data

US 2004/0264647 A1 Dec. 30, 2004

(30) Foreign Application Priority Data

Nov. 8, 2001 (DE) ..... 101 54 481

(51) Int. Cl.
*G21K 3/00* (2006.01)

(52) U.S. Cl. ..... 378/156; 378/157

(58) Field of Classification Search ..... 378/156–159, 378/117

See application file for complete search history.

(56) References Cited

U.S. PATENT DOCUMENTS

| | | | | | |
|---|---|---|---|---|---|
| 3,581,087 | A | * | 5/1971 | Brinkerhoff et al. | 250/393 |
| 4,246,488 | A | * | 1/1981 | Hura | 378/151 |
| 4,415,231 | A | | 11/1983 | Kaczensky et al. | 350/269 |
| 4,766,603 | A | | 8/1988 | Okabe et al. | 378/152 |
| 5,107,530 | A | | 4/1992 | Allison | 378/160 |
| 5,373,546 | A | * | 12/1994 | Holzermer | 378/157 |
| 5,394,452 | A | | 2/1995 | Swerdloff et al. | 378/65 |
| 5,923,724 | A | * | 7/1999 | Soukal | 378/156 |
| 6,036,362 | A | | 3/2000 | Schmitt | 378/206 |

FOREIGN PATENT DOCUMENTS

DE 198 32 973 1/2000

* cited by examiner

*Primary Examiner*—Edward J. Glick
*Assistant Examiner*—Jurie Yun
(74) *Attorney, Agent, or Firm*—Brinks Hofer Gilson & Lione

(57) ABSTRACT

An apparatus for filtering an x-ray beam emitted by an x-ray source comprises a filter, adjustable from a parked position (P) outside of a path of the x-ray beam into a filtering position (F) in the x-ray beam path. A corresponding first sensor device detects when the filter in the filtering position (F), and a corresponding second sensor device detects when the filter in the parked position (P). Further, sensor signals are communicated by the first and second corresponding sensors to an evaluation device. The evaluation device generates a report if the filter is not in at least one of the parked position (P) and the filtering position (F).

20 Claims, 4 Drawing Sheets

DEVICE FOR FILTERING AN X-RAY BEAM

Applicant claims, under 35 U.S.C. §§ 120 and 365, the benefit of priority of the filing date of Oct. 18, 2002 of a Patent Cooperation Treaty patent application Serial Number PCT/DE02/03945, filed on the aforementioned date, the entire contents of which are incorporated herein by reference, wherein Patent Cooperation Treaty patent application Serial Number PCT/DE02/03945 was not published under PCT Article 21(2) in English.

Applicant claims, under 35 U.S.C. § 119, the benefit of priority of the filing date of Nov. 8, 2001 of a German patent application Serial Number 101 54481.2, filed on the aforementioned date, the entire contents of each of which are incorporated herein by reference.

BACKGROUND

The invention relates to, in general, to medical x-ray imaging systems, and in particular to an apparatus for filtering an x-ray beam, having a filter which is adjustable from a parked position outside the x-ray beam or the x-ray beam path into a filtering position in the x-ray beam path.

The invention also relates to a medical x-ray system.

In a medical x-ray imaging system, a "quality" of a radiation, that is, an energy distribution of the radiological quanta, is determined not only by a voltage at an x-ray tube but also essentially by a downstream filtration. The filtration of the x-ray radiation is intended to substantially minimize low-energy quanta, which do not contribute substantially to an imaging and may lead only to an unnecessary radiation exposure. As a result of the filtration, a concentration point of or center of gravity of the energy distribution may shift toward higher values; the radiation is said to be "hardened".

Particularly for cardiological examinations, copper prefilters with various filter stages, that is with different absorption values, are necessary.

A filter changer with various filter stages is disclosed in German Patent Disclosure DE 198 32 973 A1 and in German Patent DE 42 29 319 C2.

An object is to disclose a filter apparatus which may enhance an operating safety for a patient to be examined using the filtered x-rays.

With respect to the apparatus referred to at the outset, this object is attained by a first sensor device for detecting the filter in the filter or filtering position and a second sensor device for detecting the filter in the parked position.

With the filter apparatus, one advantage is attained that incorrect positioning, for instance caused by failure of a structural part or a malfunction, can be ascertained substantially quickly and directly. Until now, such incorrect positioning could be ascertained only indirectly, from corresponding signs in the x-ray examination image or view found in an evaluation or observation of the x-ray image taken (reading the x-ray image). This may have caused unnecessary radiation exposure to the patient, because another x-ray image may have to be taken or a longer exposure time was necessary.

In a preferred feature, for each additional or further filter, a respective further first sensor device for detecting its filtering position and a further second sensor device for detecting its parked position may be present. Thus advantageously, filter apparatuses with a plurality of filter stages, in which a probability of incorrect or inaccurate positioning of individual filters is inevitably increased unless further precautions are taken, can be operated especially safely.

Preferably, the first and second sensor devices are embodied as photoelectric gates. Embodiments as electro-inductive, electro-capacitive or electro-resistive sensors are alternatively possible. The first and second sensor devices can also be embodied by a mechanical feeling or switch.

In another preferred feature, sensor signals are delivered or communicated to an evaluation device, which may generate a report if the filter, or one of the filters, is in neither its desired parked position nor its desired filtering position. With an evaluation device of this kind, preferably controlled electronically and/or by software, monitoring the respective positions can be automated, with a view to further enhancing safety.

The apparatus may be especially advantageous if a drive device or machine, such as a stepping motor, for moving the filter is present, as such, a corrective function of the drive device, and optionally of a control unit or device associated with the drive device as well, can also be monitored.

The filter apparatus is preferably embodied as a structural group or ensemble together with a multileaf diaphragm or collimator assembly, both of which are disposed in particular in a common housing.

For moving the filters, preferably present as a plurality of filters, in order to achieve various filter stages, an arm or handle can be separately present for each of the filters, and a first end of each arm may engage the applicably corresponding filter, while a respective second end of the arm can be subjected to a force generated by the drive device. As such, the x-ray apparatus is advantageously embodied such that as a function of a motion of the common drive device, one of the filters is either adjustable into the beam path by exertion of an adjusting force on the associated arm, or can be retrieved out of the beam path by exertion of a restoring or retrieving force on the arm.

In connection with this discussion, the term "arm" is understood to additionally mean or represent any mechanism for force transmission, for instance including a pusher, lever, rod linkage, or pivot joint.

In a preferred embodiment, a mechanism or device for holding, keeping or retaining each of the filters in a corresponding position in the beam path is present, in particular a detent mechanism or a magnetic coupling. As a result, it may be advantageously unnecessary for the drive device to generate a holding or retaining force for continuously holding the filter positioned in the beam path.

Preferably, there is a mechanism for holding and/or returning each of the filters in and/or into its position outside the beam path, in particular a restoring spring. Thus one further position is replicably defined in a simple way.

The mechanism for holding the filters in their respective positions in the beam path, in particular the spring or detent mechanism, are in particular dimensioned such that the restoring force of the restoring spring does not by itself suffice to allow a filter to leave its position, and that a filter can leave its position and return to its position outside the beam path when the restoring force generated by the drive device is exerted in addition.

In a preferred feature, the arms are mechanically encoded differently, specifically for both the adjusting motion and the retrieval motion. In particular, these arms are encoded mechanically differently such that as a function of predefined motions, different from one another, of the drive device, either one or more of the filters can be adjusted into the beam path, and that as a function of other predefined motions, also different from one another, of the drive device, either one or more of the filters can be retrieved from the beam path.

With increasing motion of the drive device in one direction, all the filters are preferably gradually adjustable into the beam path, and with increasing motion of the drive device in the opposite direction, all the filters can be retrieved gradually from the beam path.

In another preferred feature, the filters can be retrieved from the beam path in the same order in which they are adjusted into the beam path, and the adjustment and retrieval are done in particular in accordance with a first-in, first-out rule.

In addition, the filter apparatus is advantageously designed such that there is a drive device-driven slaving mechanism, which can be put into contact with two stops on each of the arms; an ON stop may be provided for subjecting the arm to the adjusting force, and an OFF stop may be provided for subjecting the arm to the restoring force. The slaving mechanism, which can also be designed as an intervention, has the advantage that the arms need not be coupled rigidly to the drive device, and so after the drive device has executed a first motion, the drive device can execute a second motion independently of the first motion.

In another special feature, for mechanically encoding the arms, the positions of the stops on different arms may be different from one another.

A further preferred feature provides a control unit for triggering the drive device; the control unit includes a memory device, in which codes of the arms that are different from one another and/or predefined motions of the drive device that are different from one another are or can be stored in memory. Preferably, motions that must be performed to realize different filter stages, that is, for introducing the filter or a combination of a plurality of filters into the beam path, are stored in memory. The stored motions can be read out electronically and are usable by the control unit for adjusting a desired filter stage or selected filter stages. Alternatively, the codes of the arms that are used by corresponding software program or programs can be stored, in order to calculate the particular motions required and trigger the drive device accordingly.

The control unit can also be embodied such that it substantially constantly records or keeps a log of which filters are located in the beam path at a given time and which ones are not. This embodiment has the advantage that the necessary motions of the drive device for adjusting a desired filter stage need not necessarily always be performed from a defined outset position of all the filters, such as all the filters not being in the beam path, but instead that under some circumstances, faster motion sequences can be employed from one filter stage to another. The required motion sequences in each case can be calculated by software, for instance. This embodiment produces the commands for driving the drive device.

The filters are, in particular, copper and/or aluminum filters or pre-filters and/or are distinguished or defined by different transmission values.

An additional scope also includes a medical x-ray system or machine, in particular for cardiology, having an x-ray source and having a filter apparatus, as described above, for filtering the x-ray beam emitted by the x-ray source.

The x-ray system is preferably designed such that an operation is interrupted if the evaluation device, which is in communication with the sensor devices, generates the report that the filter, or one of the filters, is in neither its parked position nor its filtering position.

Especially advantageously, a signal perceptible to an operator or user is output, in particular an optical or acoustical signal, if the evaluation device generates the report.

DETAILED DESCRIPTION OF THE DRAWINGS AND THE PRESENTLY PREFERRED EMBODIMENTS

Figure 1:
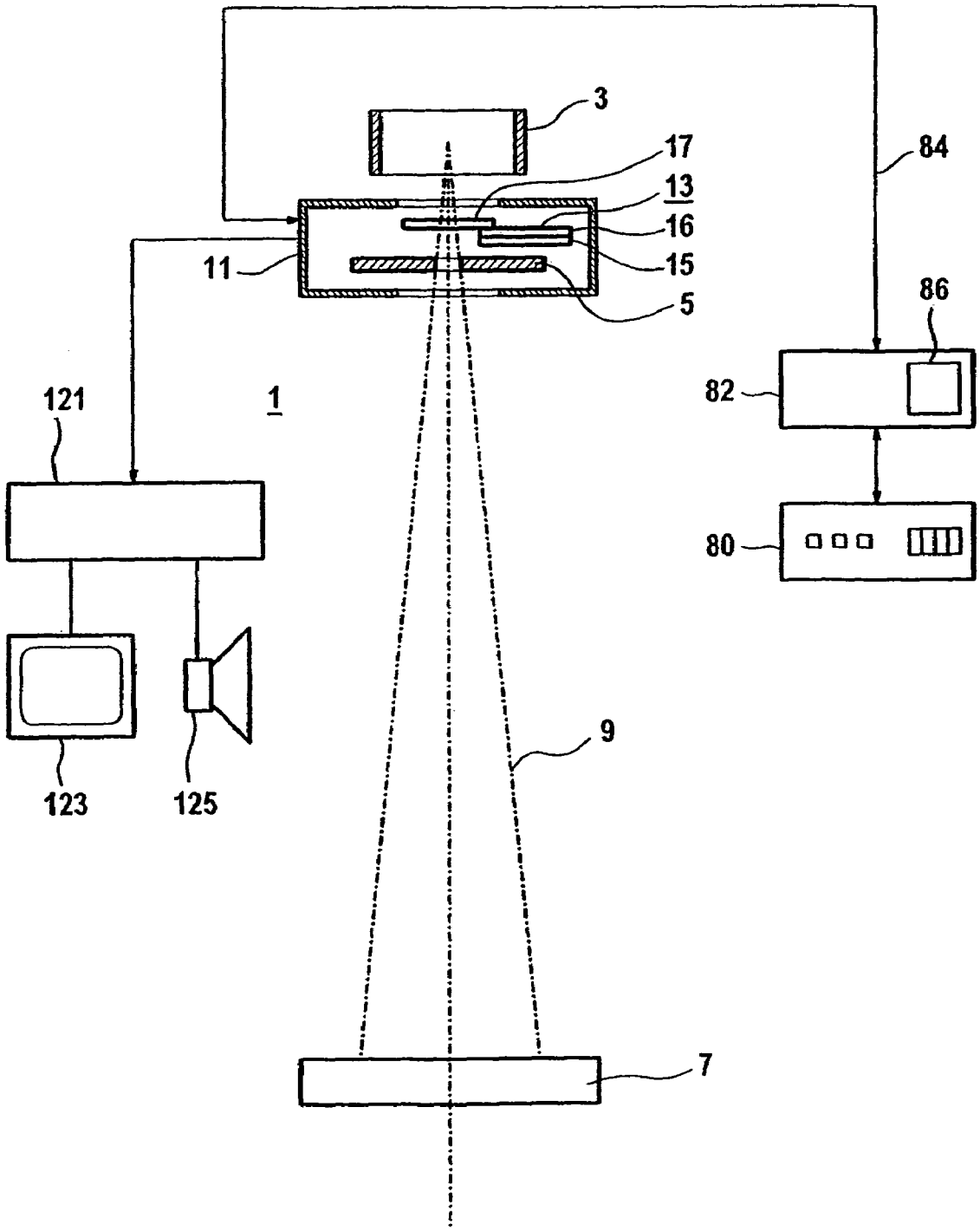
FIG. 1 is a schematic overview of a medical x-ray system.

FIG. 1 shows a medical x-ray system 1 with an x-ray tube or source 3, a multileaf diaphragm assembly 5, and a detector means 7 for taking an x-ray. The x-ray tube 3 emits an x-ray beam 9 for x-raying a patient, not shown.

Between the x-ray tube 3 and the multileaf diaphragm assembly 5, a filter apparatus 13 for filtering the x-ray beam 9 is disposed. Further, the filter apparatus together with the multileaf diaphragm assembly 5 is disposed in a common housing 11.

Figure 2:
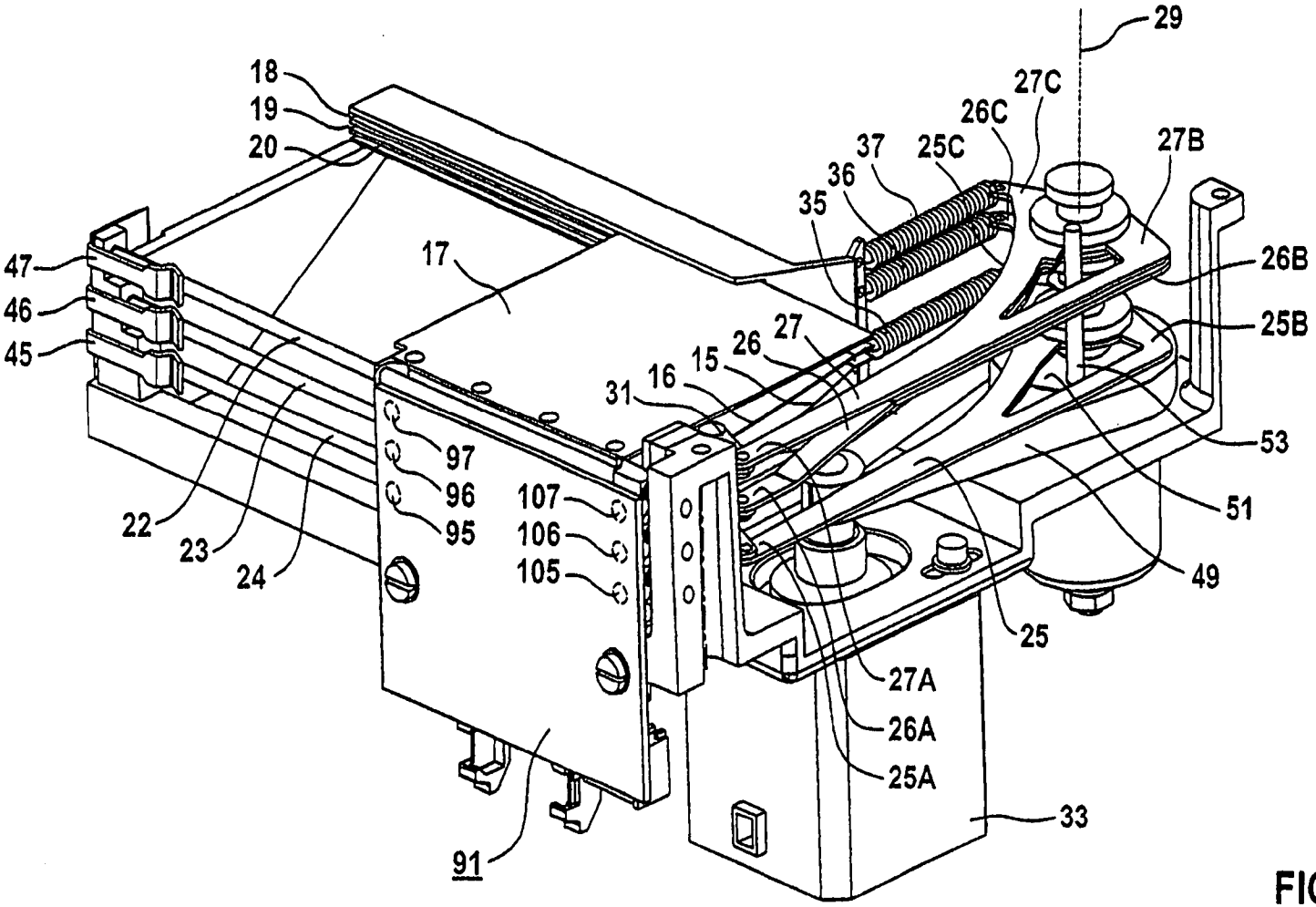
FIG. 2 is a perspective view of a filter apparatus of an x-ray beam.

The filter apparatus 13 shown in detail in FIG. 2 includes, as three filters 15, 16, 17, three variously thick copper plates, with thicknesses of 0.1 mm, 0.2 mm and 0.6 mm, respectively; in FIG. 2, only the filter 17 that is adjustable in the topmost plane is fully visible by an uppermost surface. The two filters 15, 16 that are displaceable linearly in planes below the top filter 17 are only partly visible.

Each of the filters 15, 16, 17 can be positioned in both a parked position, or OFF position, in which all three filters 15, 16, 17 are located in FIG. 2, and in an ON or active position, in which the x-ray beam 9 passes through the filters 15, 16, 17. For guiding the preferably rectangular or square filters 15, 16, 17, a corresponding guide 18, 19, 20 formed as a slit-like groove or slot is provided on one side of each of the filters 15, 16, 17, and a guide rail or guide rod 22, 23, 24 of round cross section is present on another side of each of the filters 15, 16 and 17. Along each of the guide rods 22, 23, 24, a respective slider can be moved, to which the associated filter 15, 16, 17 is secured via screws or clamped in place.

For moving each of the filters 15, 16, 17, a separate pusher, pivot joint or arm 25, 26, 27 is present; the respective first end 25A, 26A, 27A of each arm engages the associated filter 15, 16, 17, and the respective opposite, second end 25B, 26B, 27B of each arm is rotatably supported along a common imaginary axis 29. On the first end 25A, 26A, 27A, the arms 25, 26, 27 are solidly joined to the associated filter 15, 16, 17 via two hinges each, which are joined to one another via a joint or linking element, such as a hinge pin. The joint elements, of which in FIG. 2 only the uppermost joint element 31 for the thickest filter 17 is visible, may compensate for a relative motion, caused upon pivoting of the arms 25, 26, 27, between the respective ends 25A, 26A, 27A of each arm 25, 26, 27, remote from the axis 29 and the respective filter 15, 16, 17.

A respective third end 25C, 26C, 27C of each arm 25, 26, 27 is engaged by a respective return spring or restoring spring 35, 36, 37, counter to whose spring-based restoring force the filters 15, 16, 17 are movable into their respective ON or active position. For moving the filters, there is a drive device or machine 33, which is embodied as an electric motor that is rotatable in both directions. With an adjusting force generated by the drive device 33, the filters 15, 16, 17 are adjustable into the ON or active position, that is, into the x-ray beam 9 or the x-ray beam path, counter to the spring force of their restoring springs 35, 36, 37.

For each filter 15, 16, 17, there is a detent spring as a detent mechanism 45, 46, 47 on the end of the guide rods 22, 23, 24, and the slider of the applicable filter 15, 16, 17 can latch into this detent mechanism once the filter has reached its ON or active position in the x-ray beam path. This means that the drive device 33 need not generate any holding or retaining force for holding the filter 15, 16, 17 in the x-ray beam path. The detent mechanism 45, 46, 47 is dimensioned such that the spring-based restoring force of the restoring springs 35, 36, 37 is not sufficient by itself for departure from the detent device 45, 46, 47.

Conversely, a filter 15, 16, 17 can leave the corresponding detent mechanism 45, 46, 47 if—at least until leaving an operative range of the restoring springs 35, 36, 37—a restoring force generated by the drive device 33 additionally acts on the filter 15, 16, 17, a generation of which restoring force will be described in further detail hereinafter. After leaving the operative range of the restoring spring 35, 36, 37 ("unlatching"), the filter 15, 16, 17 is moved into the OFF position ("ejection") solely by the spring-based restoring force of the restoring springs 35, 36, 37. It is advantageous in this respect if in the OFF position, damping devices are present by which the particular arm 25, 26, 27 that is being accelerated is braked or slowed.

Via a belt 49, the drive device 33 drives a turntable 51, which is rotatable about the axis 29 and is located below the second ends 25B, 26B, 27B of the arms 25, 26, 27. A slaving mechanism 53 on the order of a cylindrical pin, protruding upward through recesses in the arms 15, 16, 17 is secured eccentrically to the turntable 51.

Figure 3:
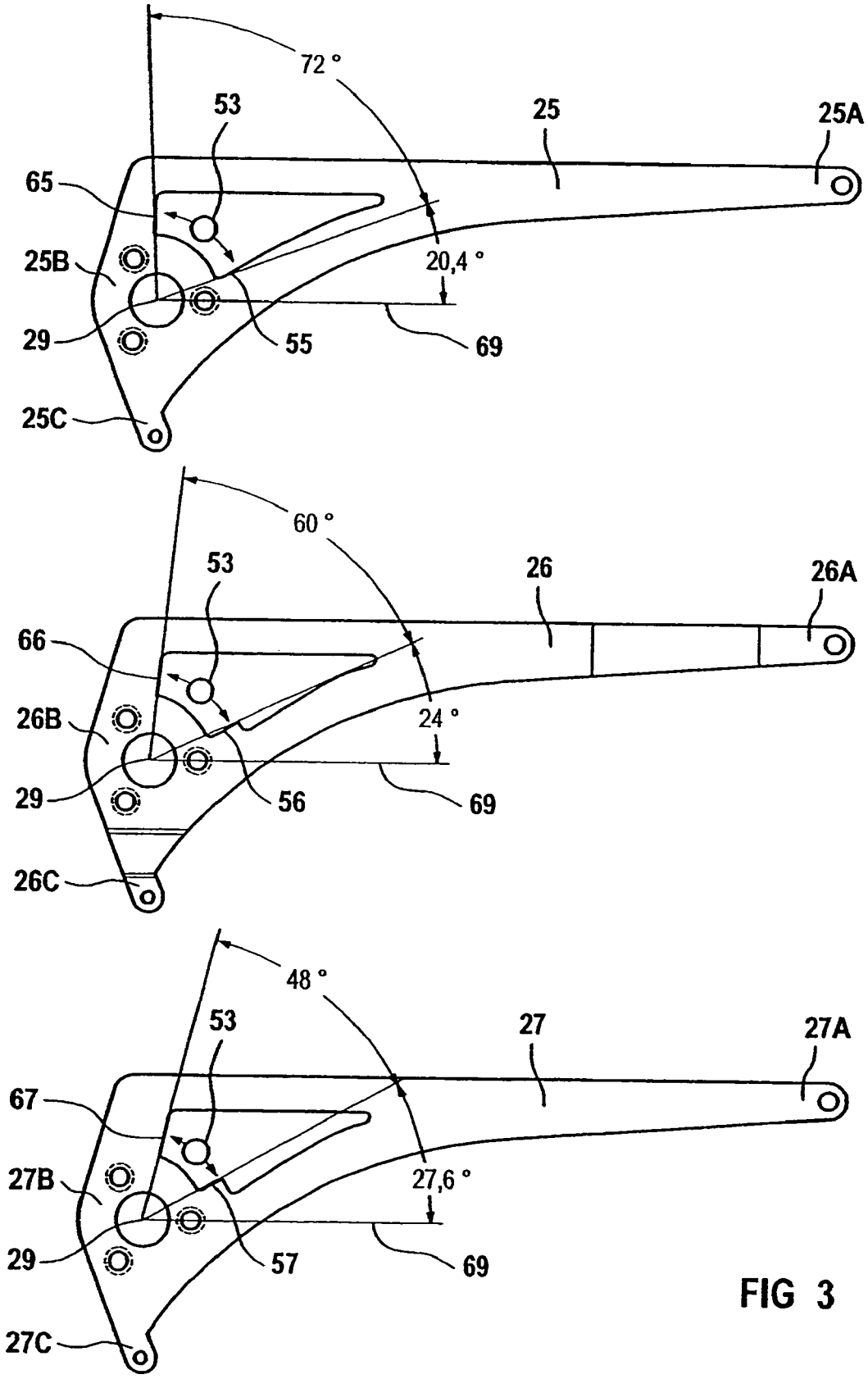
FIG. 3 illustrates variously mechanically encoded arms of the filter apparatus of FIG. 2.

For the description below, FIG. 3 will be referred to, in which the arms 25, 26, 27 are shown in the dismantled state, located side by side and viewed from above. The recesses form stops 55, 56, 57, 65, 66, 67 on the inner edges of the arms for the rotatable slaving mechanism 53. Each arm 25, 26, 27 has, as its defined ON code, an ON stop 55, 56, 57 for subjecting the arm 25, 26, 27 to the adjusting force, for which purpose the slaving mechanism rotates clockwise, carrying the applicable arm 25, 26, 27 along with it, and as its defined OFF code, it has an OFF stop 65, 66, 67, for subjecting the arm 25, 26, 27 to the restoring force, for which purpose the slaving mechanism 53 rotate counter-clockwise, carrying the applicable arms 25, 26, 27 along with it.

In addition, the arms 25, 26, 27 are essentially identical outer contours, i.e. matching or congruent outer contours. These arms 25, 26, 27 differ in terms of a shape of their respective recesses, in which the positions of the stops 55, 65; 56, 66; and 57, 67, respectively, for each of the arms 25, 26, 27 are different. With respect to the imaginary common axis 29, which extends parallel to the arms 25, 26, 27 and in this example defines the OFF position of the filters 15, 16, 17, an angular position of the ON stops 55, 56, 57 increases in substantially equal increments, beginning at the thinnest filter 15 (arm 25) and extending to the thickest filter 17 (arm 27), while an angular position of the OFF stops 65, 66, 67 decreases in substantially equal increments. A free angle opening, which is a difference between the angular position of the respective OFF stop and the angular position of the ON stop, is the greatest for the thinnest filter. The free angle position may decrease substantially steadily toward the thickest filter. Below is a table illustrating individual angles corresponding to each of the filters.

| Filter | Arm | ON Stop | OFF Stop the Recess | Free Opening of |
|---|---|---|---|---|
| 15 (0.1 mm) | 25 | 20.4° | 92.4° | 72.0° |
| 16 (0.2 mm) | 26 | 24.0° | 84.0° | 60.0° |
| 17 (0.6 mm) | 27 | 27.6° | 75.6° | 48.0° |

A function of the filter apparatus 13 for an example of a motion sequence will now be explained. For this purpose, a state will be assumed in which all the arms 25, 26, 27—in the same angular position, that is, covering one another when viewed from above—are in the parked position. This state is illustrated in FIG. 3.

When the slaving mechanism 53 moves clockwise, it comes into contact successively, that is, at staggered times, with the ON stops 55, 56, 57, specifically first with the ON stop 57 of the arm 27 for the thickest filter 17. Upon further rotation of the slaving mechanism 53, it also comes into contact with the ON stop 56 of the arm 26 for the middle filter 16 and pivots it along with it, with an angular offset of 3.6°. A similar result is subsequently obtained for the arm 25 (ON stop 55) for the thinnest filter 15. The arms 25, 26, 27 fanned out in this way are then moved onward synchronously counter to the forces of the restoring springs 35, 36, 37 upon further rotation of the slaving mechanism 53, until the forward most arm 27 has pivoted so far that the thickest filter 17 has been moved to over a protruding hump or threshold on the detent spring of the detent mechanism 47 ("latching"). Once in this position, the thickest filter 17 has been adjusted into the x-ray beam path 9. If no further filter is to be adjusted, then the slaving mechanism 53 could be moved back again in the opposite direction. For explanatory purposes, however, it is assumed here that the other filters 15, 16 are also to be adjusted. For that purpose, the slaving mechanism 53 is moved onward in the same direction, carrying all the arms 25, 26, 27 with it, until with the middle arm 26, its filter 16 has likewise been moved to above the hump or threshold in the associated detent mechanism 46, or in other words comes to be latched. This motion is possible because each of the filters 15, 16, 17 is movable even beyond its hump or threshold, or in other words an overrun is possible. The thickest filter 17 that has already latched into place can therefore be carried by the slaving mechanism 53 for a certain distance (overrun length), adapted to the maximum angular difference between the ON stops 55, 56, 57, past its hump or threshold, so as to attain latching of the middle filter 16 as well. Upon further rotation of the slaving mechanism 53 beyond the latching of the middle filter 16, then by the slaving mechanism 53—with a synchronous onward motion of all the arms 25, 26, 27 and optionally utilizing corresponding applicable overrun lengths—with the lowermost arm 25 of the thinnest filter 15 is likewise fixed in its detent means 45. Finally, after this filter 15 has moved past its hump or threshold, the slaving mechanism 53 can be moved in the opposite direction. Then in particular the thickest filter 17 and the middle filter 16 likewise move, by the length of their current respective overrun travel, back in the opposite direction as well, until they substantially reach and remain at the respective humps or thresholds of their detent mechanism 45, 46, 47 (active position). In this state, the arms 25, 26, 27 are again substantially layered one above another—covering axially one another as viewed from above. From that state, the slaving mechanism 53 moves back without being in contact with the ON stops 55, 56, 57.

The retrieval of the filters 15, 16, 17 from this state or position, in which all the filters 15, 16, 17 are in the active position and the arms 25, 26, 27 are congruent, takes place in the same order, by rotation of the slaving mechanism 53 counterclockwise. Once the slaving mechanism 53 has lost contact with the ON stops 55, 56, 57, it moves freely at first for some time. Then it comes first into contact with the OFF stop 67 of the arm 27 for the thickest filter 17, as a result of which the thickest filter 17 is moved past its hump or threshold ("unlatching"), and from there on, solely by an influence of its restoring spring 37, reaches its parked position ("ejection"). Upon further rotation of the slaving mechanism 53, this slaving mechanism then comes into contact with the OFF stop 66 of the arm 26 for the middle filter 16 and finally with the OFF stop 65 of the arm 25 for the thinnest filter 15. The filter 17, which is moved first into the x-ray beam path 9, is thus also the first to be "ejected" again.

Based on the motions described, only the filter stages 0.6 mm, 0.8 mm (=0.6 mm+0.2 mm), 0.9 mm (=0.6 mm+0.2 mm+0.1 mm) would be possible upon successive adjustments, and only the filter stages 0.3 mm (=0.9 mm−0.6 mm=0.2 mm+0.1 mm), 0.1 mm (=0.9 mm−0.6 mm−0.2 mm) would be possible upon successive ejections, or in other words 5 filter stages (not counting the unfiltered stage=0.0 mm). These last two filter stages can be generated by moving the drive device first in one direction and then in the other.

Additional filter stages can be generated by performing a change in the direction of motion of the drive device 33 at a time in which not all the filters have been adjusted into the x-ray beam 9 path (for instance, for filter stage 0.2 mm), and/or by repeatedly performing a change multiple times in the direction of motion of the drive device 33 (for instance for the filter stage 0.7 mm).

In total, the following filter stages, each resulting from the addition in the filter thicknesses, may be possible with a combination of filter motion sequences as shown in the table given below:

| Filter Stage (thickness in mm) | Motion Sequence |
|---|---|
| 0 | — |
| 0.1 | latch filters 0.6 mm, 0.2 mm, 0.1 mm<br>unlatch filters 0.6 mm, 0.2 mm |
| 0.2 | latch filters 0.6 mm, 0.2 mm<br>unlatch filter 0.6 mm |
| 0.3 | latch filters 0.6 mm, 0.2 mm, 0.1 mm<br>unlatch filter 0.6 mm |
| 0.6 | latch filter 0.6 mm |
| 0.7 | latch filters 0.6 mm, 0.2 mm, 0.1 mm<br>unlatch filters 0.6 mm, 0.2 mm<br>latch filter 0.6 mm |
| 0.8 | latch filters 0.6 mm, 0.2 mm |
| 0.9 | latch filters 0.6 mm, 0.2 mm, 0.1 mm |

In the motion sequences as given, it has been assumed that a respective filter stage is to be reached beginning from the filter stage 0 mm. Other motion sequences can result, beginning at a different filter stage.

Whichever motion sequence is required at a given time is calculated by the software program, which is executed in a control unit 82 (see FIG. 1) communicating with an input device 80 (see FIG. 1) for triggering the drive device 33. The electronic-digital control unit 82 acts on the drive device 33 via a line 84. The control unit 82 includes a memory device 86 (see FIG. 1), in which the various codes of the arms 25, 26, 27, that is, the angular positions of the ON stops 55, 56, 57 and the angular positions of the OFF stops 65, 66, 67 are stored or can be stored in memory. The software program furthermore stores a current instantaneous position of all the filters 15, 16, 17 in memory, beginning at a reset position (not all the filters being in the beam path 9). As a function of a desired filter stage, selected via the input device 80, and as a function of the instantaneous position of the filters 15, 16, 17, the software determines the requisite motion sequence for the drive device 33.

By means of the mechanical encoding of the individual filter planes, all the different filter stages that are in principle possible, which is a total of 8, can be achieved with only three different filters 15, 16, 17. The filter apparatus 13 requires only little space and moreover makes very short filter changing times possible. A maximum time required to change from one filter stage to another is approximately 0.6 seconds.

For detecting both the filtering position (active or ON position) and the parked position (OFF position) of each of the filters 15, 16, 17, there is a sensor module 91, which is visible in FIG. 1 along with a photoelectric gate board mounted laterally next to the filters 15, 16, 17.

Figure 4:
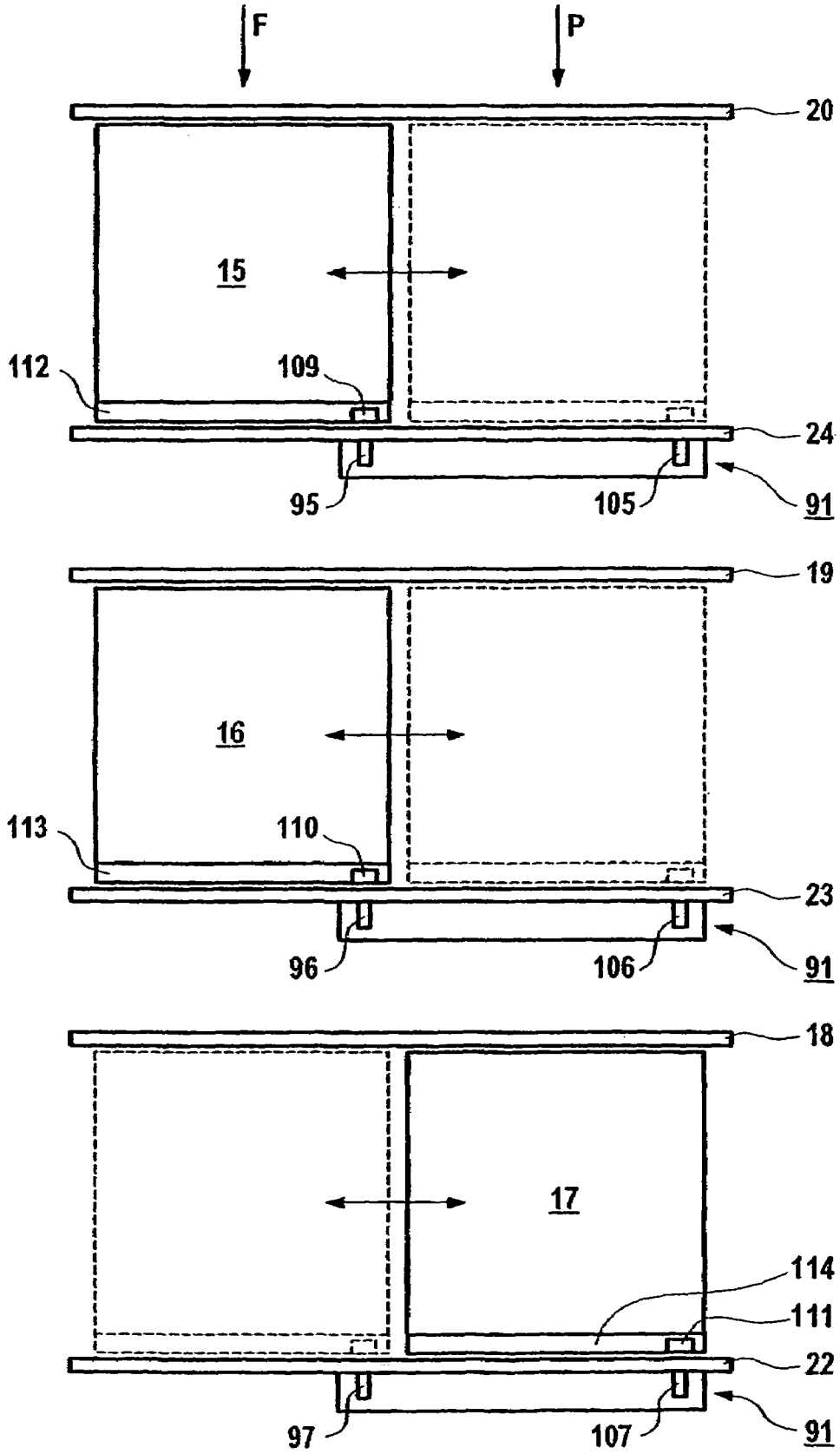
FIG. 4 illustrates schematically sensor devices of the filter apparatus of FIG. 2.

A function of the sensor module 91 will be described in further detail in conjunction with FIG. 4, in which the filters 15, 16, 17 along with their guides 18, 19, 20 and guide rods 22, 23, 24 are shown in a dismantled state of the apparatus 13. The three filter planes of the apparatus 13 are shown in FIG. 4—side by side—each viewed from above.

In each filter plane, there is a corresponding first sensor device 95, 96, 97 for detecting the applicable filter 15, 16, 17 in its filtering position, namely F, and a corresponding second sensor device 105, 106, 107 for detecting this filter 15, 16, 17 in its parked position, namely P. The positions of the sensor devices 95, 96, 97, 105, 106, 107, which are each mounted as electronic components on a side toward the filter of the photoelectric gate board of FIG. 1, are shown in dashed lines in FIG. 1. Each of the sensor devices 95, 96, 97, 105, 106, 107 includes a light source and a light detector. The slides 112, 113, 114 to which the filters 15, 16, 17 are secured each carry a respective reflector 109, 110, 111. If the reflector 109, 110, 111 comes to be located in front of or next to one of the sensor devices 95, 96, 97, 105, 106, 107, the light of the light source is reflected and converted by the applicable light detector into a sensor signal, which indicates a presence of the filter 1 5, 16, 17 belonging to that particular reflector 109, 110, 111. In FIG. 4, the filters 15, 16 are in the filtering position F, so that their first sensor devices 95, 96 output a sensor signal that indicates a corresponding presence of the filters 15, 16, and their second sensor devices 105, 106 output a sensor signal indicating a corresponding absence. Conversely, the filter 17 is in the parked position P, so that its second sensor device 107 outputs a sensor signal indicating the presence of the filters 17, and its first sensor device 97 outputs a sensor signal indicating the absence of the filters 17.

Each one of the first sensor devices 95, 96, 97 and each one of the second sensor devices 105, 106, 107 are spaced apart from one another in a direction of displacement travel of the filters 15, 16, 17, made possible essentially by an allowable displacement travel, and in particular by the spacing of the parked position P from the filter position F. The sensor devices 95, 96, 97, 105, 106, 107 are positioned such that each of the filters 15, 16, 17 generates a presence signal in its first sensor device 95, 96, 97 or its second sensor device 105, 106, 107, as applicable, only in the correct filter position F and the correct parked position P, respectively. In other potential positions or intermediate positions, none of the sensor devices 95, 96, 97, 105, 106, 107 generates any presence signal.

The sensor signals are delivered to an evaluation device 121 (see FIG. 1), which generates a report if one of the filters 15, 16, 17 is in neither its parked position P nor its filtering position F. This report, generated in the form of an electronic signal, is converted, optionally in a display device 123 (see FIG. 1) communicating with the evaluation device 121, into a warning report that can be perceived or viewed by the operator. As such, an acoustical warning is outputted by a speaker 125, or a visual alert or warning is viewed on a screen 123 (see FIG. 1).

The invention claimed is:

1. An apparatus for filtering an x-ray beam emitted by an x-ray source, the apparatus comprising:

a filter, adjustable from a parked position (P) outside of a path of the x-ray beam into a filtering position (F) in the x-ray beam path; and a first sensor device for detecting the filter in the filtering position (F), and a second sensor device for detecting the filter in the parked position (P), wherein the first and second sensor devices are operable to communicate sensor signals to an evaluation device, the evaluation device operable to generates a report if the filter is not in at least one of the parked position (P) and the filtering position (F).

2. The apparatus of claim 1, wherein the first and second sensor devices comprise photoelectric gates.

3. The apparatus of claim 2, wherein the first and second sensor devices for the filters are photoelectric gates, and wherein the filters is a copper filter.

4. The apparatus of claim 1, wherein the filter comprises a copper filter.

5. The apparatus of claim 1, further comprising:

a drive device for moving the filter.

6. The apparatus of claim 1, further comprising:

a housing where a multileaf diaphragm assembly, the filter and the first and second sensors are disposed in the housing.

7. The apparatus of claim 6, wherein a drive device for moving the filter is disposed in the housing.

8. The apparatus of claim 1, wherein the apparatus is embodied in an x-ray system such that an operation of the x-ray system is interrupted if the evaluation device generates the report.

9. The apparatus of claim 8, wherein a signal perceptible to the operator is output if the evaluation device generates the report.

10. The apparatus of claim 9, wherein the signal is optical or acoustical.

11. An imaging x-ray system having an x-ray source and an apparatus for filtering an x-ray beam emitted by the x-ray source, the system comprising:

a plurality of filters, each independently adjustable from a parked position P) outside of a path of the x-ray beam into a filtering position (F) in the x-ray beam path, and each of the plurality of filters having corresponding first and second sensor devices, wherein each corresponding first sensor device detects whether the respective one of the plurality of filters is in the filtering position (F), and each corresponding second sensor device detects whether the respective one of the plurality of filters is in the parked position (P); and an evaluation device, wherein the first and second sensor devices are operable to communicate sensor signals to the evaluation device, the evaluation device operable to generates a report for each one of the plurality of filters that is not in at least one of the parked position (P) and the filtering position (F).

12. The apparatus of claim 11, wherein the first and second sensor devices for each of the plurality of filters are photoelectric gates.

13. The system of claim 11, wherein each of the plurality of filters is a copper filter.

14. The system of claim 11, further comprising a drive device for moving each of the plurality of filters.

15. The system of claim 11, wherein the first and second sensor devices for each of the plurality of filters are photoelectric gates and wherein each of the plurality of filters is a copper filter.

16. The system of claim 15, wherein the system and a multileaf diaphragm assembly are disposed in a common housing.

17. The system of claim 16, wherein an operation of the x-ray imaging system is interrupted if the evaluation device generates the report.

18. The system of claim 11, wherein the system and a multileaf diaphragm assembly are disposed in a common housing.

19. The system of claim 11, wherein an operation of the x-ray imaging system is interrupted if the evaluation device generates the report.

20. The apparatus of claims 19, wherein a signal perceptible to the operator is output if the evaluation device generates the report.

* * * * *

UNITED STATES PATENT AND TRADEMARK OFFICE

CERTIFICATE OF CORRECTION

PATENT NO. : 7,072,447 B2
APPLICATION NO. : 10/494473
DATED : July 4, 2006
INVENTOR(S) : Harald Graf et al.

It is certified that error appears in the above-identified patent and that said Letters Patent is hereby corrected as shown below:

On the Title Page

In column 1, item (73), delete "AG" and substitute --Aktiengesellschaft-- in its place.

In the Claims

Column 9, in claim 1, line 11, after "device operable to" delete "generates" and substitute --generate-- in its place.

Column 9, in claim 3, line 2, before "are photoelectric gates" delete "filters" and substitute --filter-- in its place.

Column 9, in claim 3, line 3, before "is a copper filter." delete "filters" and substitute --filter-- in its place.

Column 10, in claim 11, line 17, before "a report for each one" delete "generates" and substitute --generate-- in its place.

Signed and Sealed this

Third Day of April, 2007

JON W. DUDAS
*Director of the United States Patent and Trademark Office*